US008118109B1

(12) United States Patent
Hacker

(10) Patent No.: US 8,118,109 B1
(45) Date of Patent: Feb. 21, 2012

(54) ROOF ELEMENTS COMPRISING INTEGRAL FIRE SUPPRESSION SYSTEM

(76) Inventor: Christopher L. Hacker, Atoka, TN (US)

( * ) Notice: Subject to any disclaimer, the term of this patent is extended or adjusted under 35 U.S.C. 154(b) by 145 days.

(21) Appl. No.: 12/384,924

(22) Filed: Apr. 10, 2009

Related U.S. Application Data

(60) Provisional application No. 61/123,569, filed on Apr. 10, 2008.

(51) Int. Cl.
*A62C 3/00* (2006.01)

(52) U.S. Cl. ..... 169/54; 169/5; 169/16; 239/282; 239/556; 239/565; 239/566

(58) Field of Classification Search ..... 169/54, 169/51, 16, 5, 17, 45, 46, 66; 239/548, 556, 239/565, 566, 208, 282, 283
See application file for complete search history.

(56) References Cited

U.S. PATENT DOCUMENTS

| | | | | |
|---|---|---|---|---|
| 124,534 | A * | 3/1872 | Barrett | 169/16 |
| 128,534 | A * | 7/1872 | Carl | 169/16 |
| 873,451 | A * | 12/1907 | Mueller | 239/208 |
| 1,620,142 | A * | 3/1927 | Thompson | 239/208 |
| 2,865,674 | A | 12/1958 | Jelmeland | |
| 3,754,600 | A | 8/1973 | Miller | |
| 4,175,703 | A | 11/1979 | Valiant | |
| 4,991,657 | A | 2/1991 | LeLande, Jr. | |
| 5,083,618 | A | 1/1992 | Hayes | |
| 5,165,482 | A | 11/1992 | Smagac et al. | |
| 5,263,543 | A | 11/1993 | Nigro | |
| 5,732,511 | A | 3/1998 | Scott | |
| 6,065,546 | A | 5/2000 | Uetake et al. | |
| 6,360,968 | B1 | 3/2002 | Orrange et al. | |
| 6,732,951 | B1 * | 5/2004 | Salazar et al. | 239/209 |
| 6,929,072 | B2 | 8/2005 | Brown | |
| 6,964,379 | B2 | 11/2005 | Crowley | |
| D524,407 | S | 7/2006 | Crowley | |
| D542,886 | S | 5/2007 | Crowley | |

* cited by examiner

*Primary Examiner* — Jason Boeckmann
(74) *Attorney, Agent, or Firm* — Montgomery Patent & Design, LLC; Robert C. Mongomery; Joseph T. Yaksich

(57) ABSTRACT

A system by which a building structure is protected from wildfires, adjacent structure fires, and similar disasters while also affording a method to clean the roof using a plurality of specially-formed shingles, end caps, and ridge units designed to deliver a dispersing water spray, is herein disclosed. The shingles and ridge units would be provided in sectional pieces that interconnect theretogether to extend across a roof area. The end cap units provide plumbing connections thereto connected shingle units and a central water supply line within the structure. The system covers the roof and end wall areas of the building structure with water, thereby preventing ignition from an external source to take place. The system can also be used to clean the roof of dirt and debris if desired, and may additionally protection from chemical, biological, and/or radiological (CBR) attacks by rinsing off contaminates.

15 Claims, 12 Drawing Sheets

ROOF ELEMENTS COMPRISING INTEGRAL FIRE SUPPRESSION SYSTEM

RELATED APPLICATIONS

The present invention was first described in and claims the benefit of U.S. Provisional Application No. 61/123,569, filed Apr. 10, 2008, the entire disclosures of which are incorporated herein by reference.

FIELD OF THE INVENTION

The present invention relates generally to a fire protection system attachable to a building structure and, more particularly, to said system providing a protection means thereto said structure utilizing interconnecting roofing shingles incorporating an integral fire suppression system.

BACKGROUND OF THE INVENTION

Protecting homes and other building structures from fire is a daunting task for homeowners and firefighters. While fire fighters have experience and equipment to stop fires once they have begun, they provide very little preventive protection and they must be notified and travel to the location of the structural fire. Integrated sprinkler systems and other fire prevention methods are commonly used in large commercial structures, but are rarely seen in residential structures due to the complexity and cost.

Additionally, wildfires frequently threaten people and property in residential areas. These fires can become so large and uncontrolled that there may be no professional firefighting assistance available in time to safe a home. Oftentimes, homeowners try to save their residences by using a garden hose to protect their roofs from falling embers. Disadvantageously, the homeowner can only cover a small portion of the total roof at one time and the water pressure may also be reduced due to other nearby fire fighting activities. Attempts to cover more area include U.S. Pat. No. 6,360,968, issued in the name of Orrange et al., describes a wildfire protection system comprising a plurality of rotating sprinklers which are temporarily places on roofs as needed and U.S. Pat. No. 6,929,072, issued in the name of Brown, which describes a roof soaking device and method comprising a base support for a sprinkler which is mounted to the roof of the building structure and is in fluid communication with a home water supply. Unfortunately, this places the homeowner at risk since they must remain outside until the threat of fire has passed and requires the placement and positioning of the sprinklers as identified.

Attempts to provide more permanent directed amounts of streaming water onto roof areas in order to cool the structure or extinguish fire include; U.S. Pat. No. 2,865,674, issued in the name of Jelmeland, which describes a combination of sprinkling and fire extinguishing apparatus and guttering which re-circulates water flow from a roof back through the sprinklers and U.S. Pat. No. 4,175,703, issued in the name of Valiant, which describes a spray cooling system for gamble roofs comprising a conduit mounted atop a roof area adjacent to the roof summit. U.S. Pat. No. 5,083,618, issued in the name of Hayes, describes a bush fire protection for a building comprising a sprinkler system which is installed around the perimeter of the building structure. These attempts can be cumbersome to install and be unsightly when compared to the backdrop of a home and manicured yard.

U.S. Pat. No. 6,964,379, issued in the name of Crowley, describes an exterior fire suppression system and method for installation comprising sprinkler system connected to a water supply which is mounted with the roof structure and substantially hidden from view when the system is inactive. Although the Crowley system provides a discreet method of fire protections it still suffers from various disadvantages as described above.

Other attempts have been made in the past to overcome these disadvantages and provide a means of protecting structures from fire, although the present invention substantially departs from the conventional solutions and in doing so provides a means by which the building structure can be protected from fire and other hazards without the aforementioned problems. Among the relevant attempts to address these problems are several U.S. patents, including U.S. Pat. Nos. 3,754,600; 4,991,657; 5,165,482; 5,263,543; 5,732,511; and 6,065,546.

Additionally, ornamental designs for sprinklers and vents exist, particularly, U.S. Pat. No. D 542,407 and D 542,886. However, none of these designs are similar to the present invention.

While these devices fulfill their respective, particular objectives, each of these references suffers from one (1) or more of the aforementioned disadvantages. Accordingly, there exists a need for a means to protect houses, buildings and other structures from adjacent flames or falling embers from nearby forest fires, wildfires. The development of the invention herein described fulfills this need.

SUMMARY OF THE INVENTION

In view of the foregoing references, the inventor recognized the aforementioned inherent problems and observed that there is a need for a means to protect houses, buildings and other structures from adjacent flames or falling embers from nearby forest fires, wildfires, or even nearby structure fires in an automatic and simple manner and thus, the object of the present invention is to solve the aforementioned disadvantages.

To achieve the above objectives, it is an object of the present invention to provide roof elements comprising an integral fire suppression system which is operably incorporated onto a roof area of a building structure designed to deliver a water spray which provides a fire protection means to the building structure and also a simple means to clean a roof area. The invention provides a means to completely soak the roof and end wall areas of the building structure, thereby making it very difficult for ignition from an external source to take place.

Another object of the present system is to provide a system comprising a plurality of end cap sprinkler units, a plurality of sprinkler shingle units, a plurality of sprinkler ridge units, and an interconnected network of supply plumbing. The sprinkler units utilize mechanical and fluid communication with each other to form an interconnected water dispersing means to the building structure such that the roof area and vertical end wall areas are kept wet during times of exposure to possible ignition sources.

Yet still another object of the present system is to provide the sprinkler units comprising internal unit conduit comprising internally molded circular water distribution means forming an integrated matrix of ports which provides a means of containing internal fluid pressures and a water-tight connection between the units.

Yet still another object of the present system is to provide the plurality of interconnected sprinkler units. The connected sprinkler shingle units form a linear assembly which is integrated within a conventional roofing system between parallel rows of standard shingles. The connected sprinkler ridge units form a linear assembly which is integrated within a conventional roofing system at a roof apex area.

Yet still another object of the present system is to provide the sprinkler shingle unit comprising a sprinkler shingle housing, a sprinkler shingle nozzle, a fastening tab, an internal shingle unit conduit, a male connector, an "O"-ring, a male conduit connector, and a corresponding female connector at an opposing end position.

Yet still another object of the present system is to provide the sprinkler ridge unit comprising a plurality of sprinkler ridge nozzles, a sprinkler ridge housing, an integral ridge unit conduit, a male connector, an "O"-ring, a male conduit connector, and a corresponding female connector at an opposing end position.

Yet still another object of the present system is to provide the end cap unit comprising an end cap nozzle, an internal end cap conduit, a female connector for the right-hand end cap unit and a male connector for the left-hand end cap unit which provides left-hand and right-hand installation means to an assembly of sprinkler shingle units along opposing end portions of a roof area.

Yet still another object of the present system is to provide the internal shingle unit conduit formed within the sprinkler shingle housing comprising an attachment means to the sprinkler shingle nozzle and provides a means of fluid communication.

Yet still another object of the present system is to provide the sprinkler shingle nozzle located on the front surface of the sprinkler shingle unit which provides a conical or fan-shaped water spray pattern along the roof area.

Yet still another object of the present system is to provide the sprinkler ridge nozzle located along opposing upper surfaces of the sprinkler ridge units extending in a generally horizontal plane which provides a conical or fan-shaped water spray pattern along the roof area.

Yet still another object of the present system is to provide the end cap nozzle which is mounted and directed toward a respective end wall of the building structure.

Yet still another object of the present system is to provide the fastening tab which provides a means of attaching the sprinkler shingle unit to the roof area using common fasteners.

Yet still another object of the present system is to provide the end cap units comprising plumbing connections to the shingle units which provide a protective water spray to end wall portions of the building structure.

Yet still another object of the present system is to provide the supply plumbing which receives a water supply obtained from an available water supply such as a municipal water supply, a reservoir, a well, or the like.

Yet still another object of the present system is to provide the sprinkler units comprising a low-profile and aerodynamic design with tapered upper and lower edges so as to allow high velocity winds to move freely over the sprinkler units during extreme weather conditions and storms without causing damage to the system or surrounding roof area.

Yet still another object of the present system is to provide the shingles and ridge units which are provided in sectional pieces that interconnect together to form a desired length as needed.

Yet still another object of the present system is to provide a system which may be incorporated into both new construction or installed to existing building structures with equal benefit.

Yet still another object of the present system is to provide a method of utilizing the system which provides a quick means of preventing nearby any type of fire from igniting a roof in a manner that is safe and efficient as well.

Yet still another object of the present system is to provide a method of utilizing the system which provides a means to perform periodic cleaning of the roof area to remove dirt and debris and may also offer relief and protection from chemical, biological, or radiological threats by rinsing contaminates off of the roof and wall areas.

Further objects and advantages of the present system will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
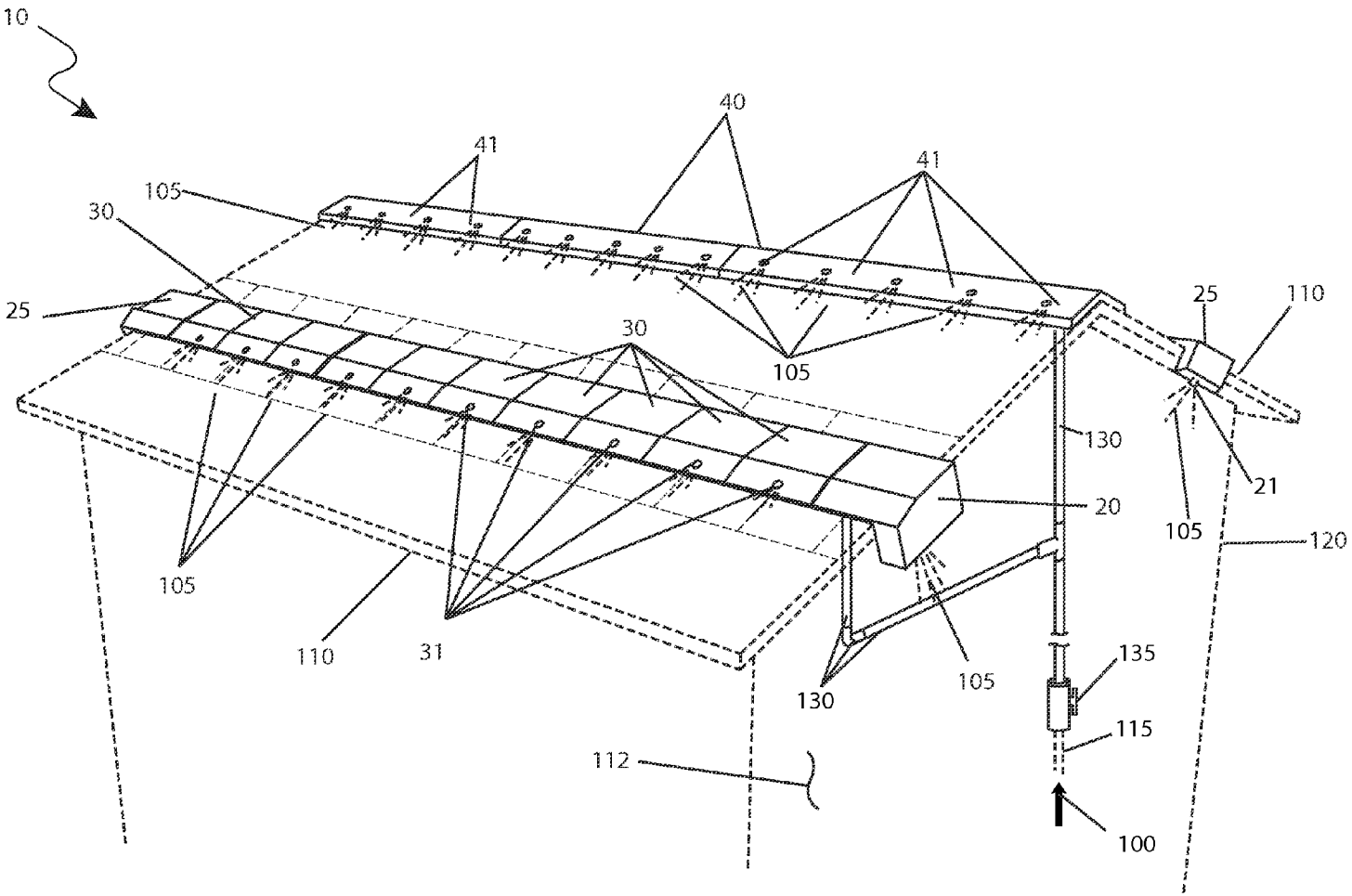
FIG. 1 is an environmental view of roof elements comprising integral fire suppression system 10 operably incorporated thereonto a roof area 110 of a housing structure 120, according to the preferred embodiment of the present invention.

10 roof elements comprising integral fire suppression system

20 right-hand end cap sprinkler unit

21 end cap nozzle

23 end cap sprinkler nozzle
25 left-hand end cap sprinkler unit
30 sprinkler shingle unit
31 sprinkler shingle nozzle
32 sprinkler shingle housing
34 fastening tab
35 first male connector portion
36 first female connector portion
37 "O"-ring
38 second male connector portion
39 second female connector portion
40 sprinkler ridge unit
41 sprinkler ridge nozzle
42 sprinkler ridge housing
50 shingle unit conduit
51 ridge unit conduit
52 end cap conduit
58 male conduit connector
100 water flow
105 water spray pattern
110 roof area
112 end wall area
115 water supply plumbing
120 building structure
130 system supply plumbing
135 valve
140 plug
150 common fastener
155 fastener aperture

DETAILED DESCRIPTION OF THE PREFERRED EMBODIMENT

Figure 4A:
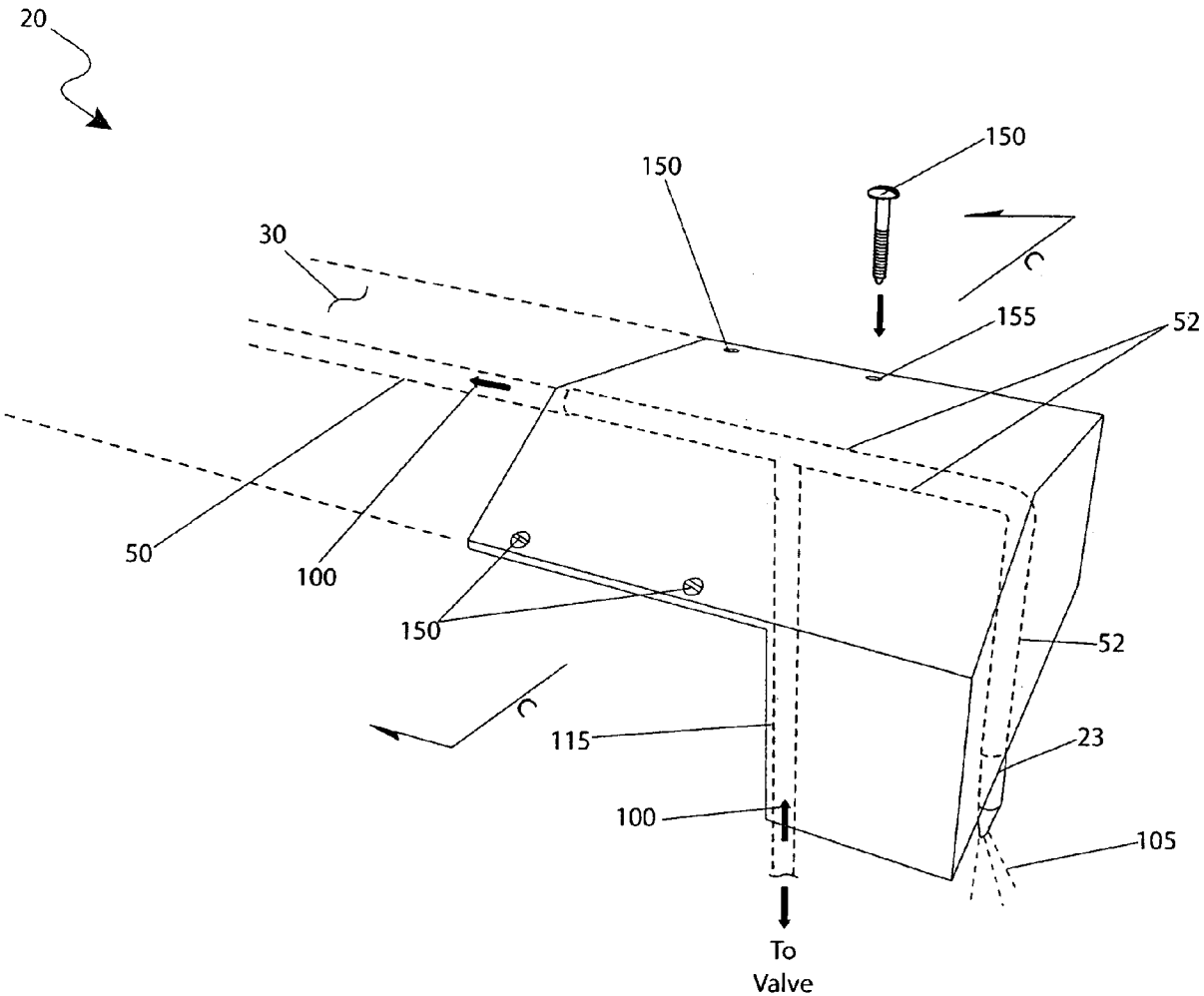
FIG. 4*a* is a front perspective view of a right-hand end cap unit portion 20 of roof elements comprising integral fire suppression system 10, according to the preferred embodiment of the present invention.
Figure 4B:
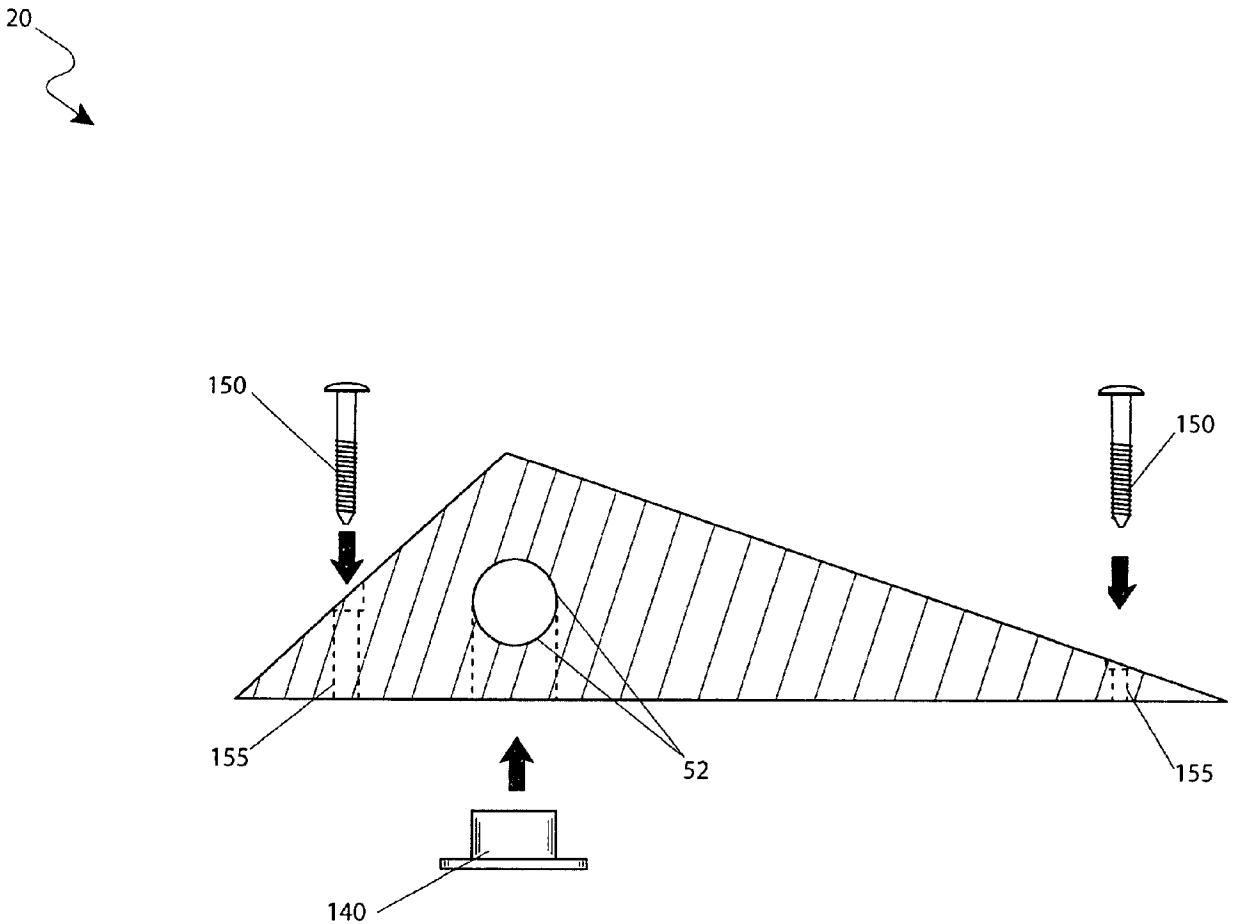
FIG. 4*b* is a section view of the right-hand end cap unit portion 20 taken along section line C-C (see FIG. 4*a*), according to the preferred embodiment of the present invention.
Figure 4C:
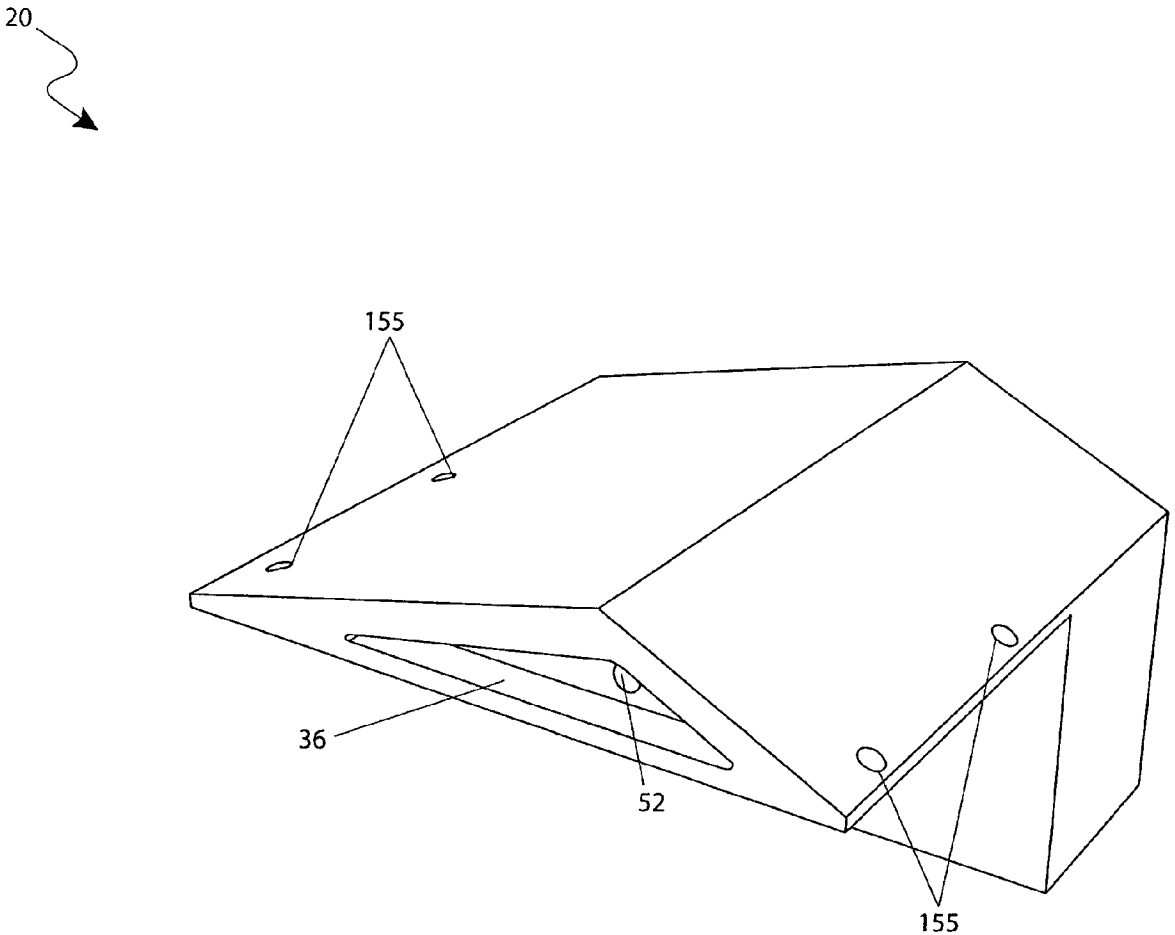
FIG. 4*c* is a perspective view of a right-hand end cap unit portion 20 of roof elements comprising integral fire suppression system 10, according to the preferred embodiment of the present invention; and, FIG. 4*d* is a perspective view of a left-hand end cap unit portion 25 of roof elements comprising integral fire suppression system 10, according to the preferred embodiment of the present invention.
Figure 4D:
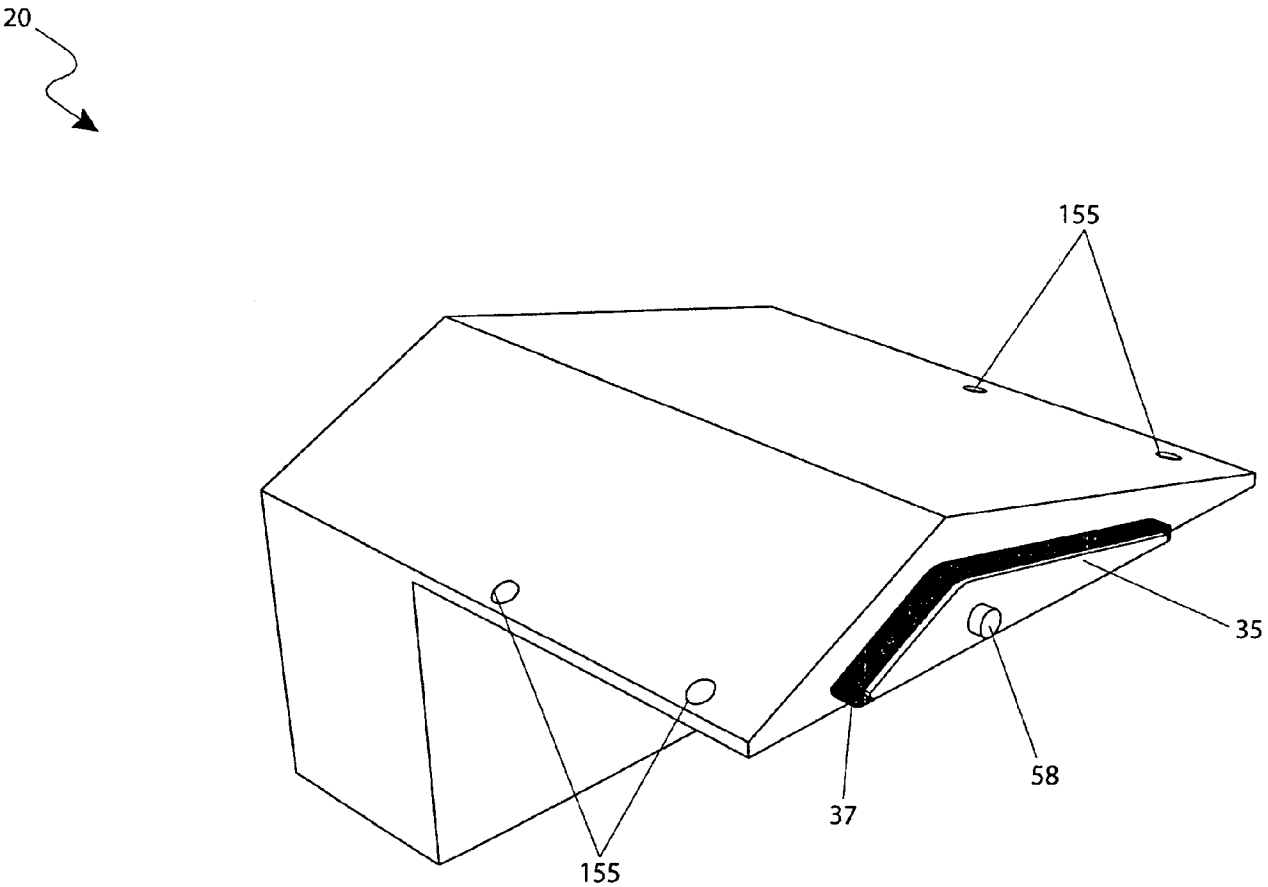

The best mode for carrying out the invention is presented in terms of its preferred embodiment, herein depicted within the FIGS. 1 and 4*d*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes roof elements comprising an integral fire suppression system (herein described as the "system") 10, which provides protection thereto a building structure 120 from wildfires, adjacent structure fires, and similar disasters while also affording a method to clean a roof area 110 using a plurality of water dispersing shingles 30, right-hand end caps 20, left-hand end caps 25, and ridge units 40 designed to deliver a water spray 105. The shingles 30 and ridge units 40 would be provided in sectional pieces that interconnect together to form a desired length. The end cap units 20 comprise plumbing connections thereto the shingle units 30 to provide a protective water spray thereto end wall portions of said building structure 120. The system 10 is envisioned to completely soak the roof 110 and end wall areas 112 of the building structure 120, thereby making it very difficult for ignition therefrom an external source to take place. A water supply 115 thereto the system 10 is obtained therefrom an available water supply such as a municipal water supply, a reservoir, a well, or the like. Additionally, the system 10 can be used to perform periodic cleaning of said roof area 110 to remove dirt and debris and may also offer relief and protection from chemical, biological, and/or radiological (CBR) threats by rinsing contaminates off said roof 110 and wall 112 areas.

Referring now to FIG. 1, an environmental view of the system 10 operably incorporated thereonto a roof area 110 of a housing structure 120, according to the preferred embodiment of the present invention, is disclosed. The system 10 comprises a plurality of end cap sprinkler units 20, 25, a plurality of sprinkler shingle units 30, a plurality of sprinkler ridge units 40, and an interconnected network of system supply plumbing 130. Said sprinkler units 20, 25, 30, 40 comprise mechanical and fluid communication therewith each other to form an interconnected water dispersing 105 means thereto a building structure 120 such that a roof area 10 and vertical end wall areas 112 are kept wet during times of exposure thereto possible ignition sources. The system 10 may be incorporated thereinto both new construction as well as installed thereto existing building structures 120 with equal benefit. The system 10 is envisioned to work in conjunction with, and during installation of, conventional roofing materials common in the industry. The system 10 is to be affixed and integrated thereinto a conventional roofing project along a roof area 110 using common roofing fasteners 150 such as roofing nails, screws, or the like. The system 10 is depicted here utilizing a linear assembly of sprinkler shingle units 30 and corresponding end cap sprinkler units 20, 25 located at both end portions thereof; however, any number of sprinkler shingle units 30 and end cap units 20, 25 may be arranged in a linear fashion or in a parallel manner along said roof area 110 based upon a particular roof size, roof pitch, or desired protective water spray pattern 105, and as such should not be interpreted as a limiting factor of the system 10.

The end cap sprinkler units 20, 25, shingle sprinkler units 30, and ridge sprinkler units 40 provide low-profile and aerodynamic designs comprising tapered upper and lower edges so as to allow high velocity winds to move freely over said units 20, 25, 30, 40, such as during extreme weather conditions and storms, without causing damage to the system 10 or surrounding roof area 110. Said units 20, 25, 30, 40 comprise solid injection-molded plastic members using preferably made using polyvinyl chloride (PVC) or equivalent plastic material. The units 20, 25, 30, 40 further comprise respective internal shingle unit conduit 50, ridge unit conduit 51, and end cap conduit 52. Said conduits 50, 51, 52 comprise an internally molded circular water distribution means forming an integrated matrix of ports approximately one-half (½) inch in diameter being capable of containing internal fluid pressures of approximately one-hundred fifty (150) pounds per square inch. The interconnecting conduits 50, 51, 52 are envisioned to provide water-tight connections therebetween said units 20, 25, 30, 40 and water supply plumbing 115 preferably utilizing common PVC cement joining of male and female features or equivalent sealing means.

Figure 2A:
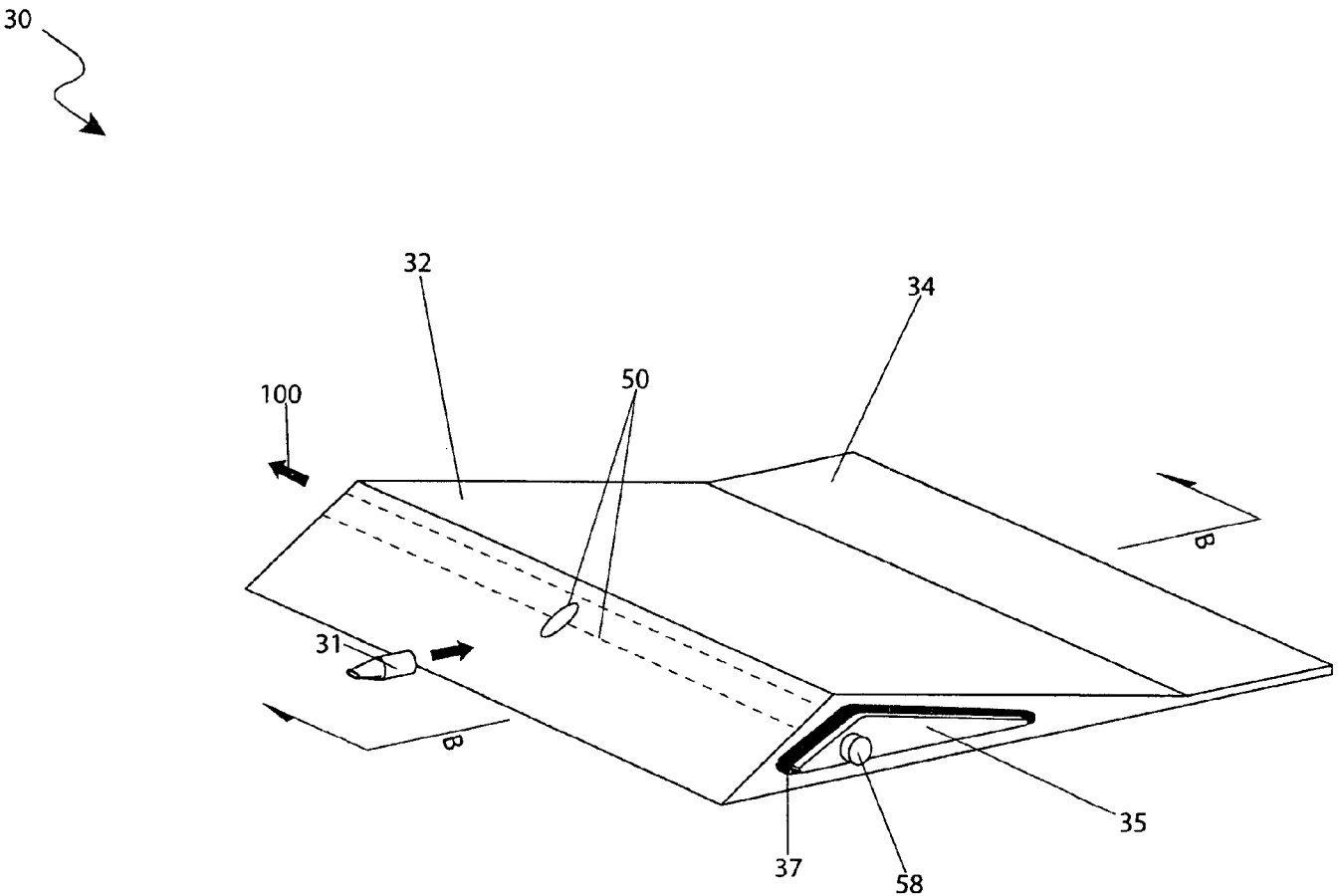
FIG. 2*a* is a front perspective view of a sprinkler shingle unit portion 30 of roof elements comprising integral fire suppression system 10, according to a preferred embodiment of the present invention.
Figure 2B:
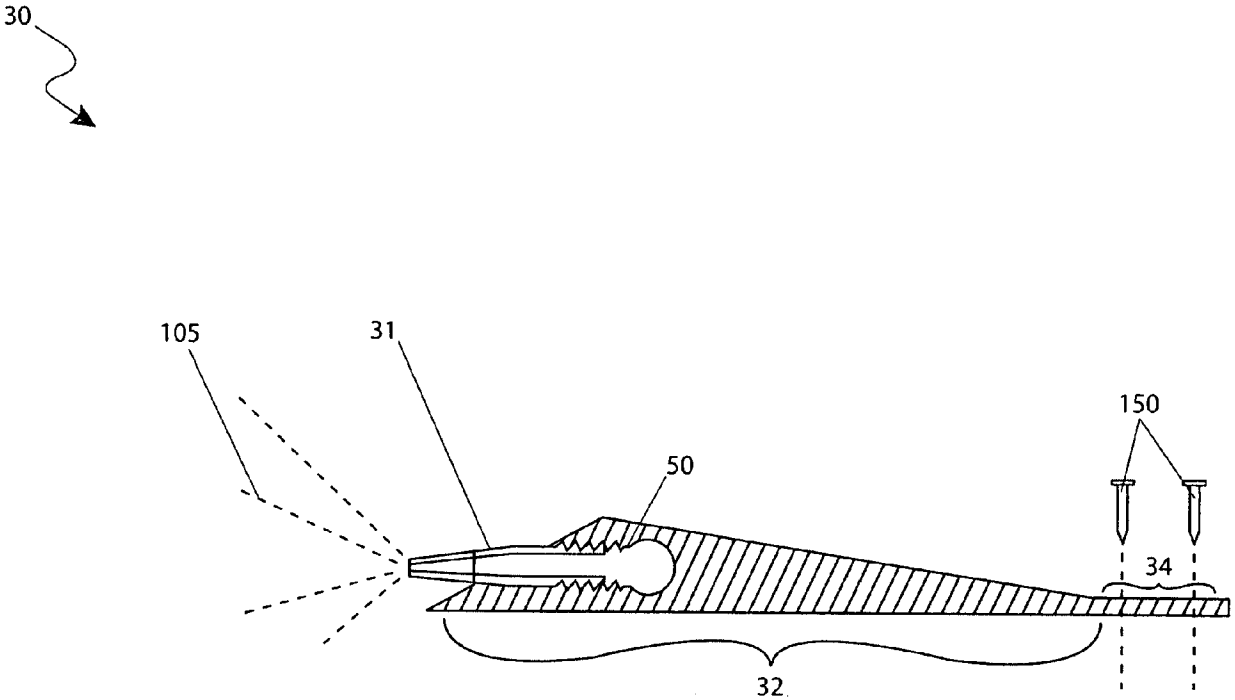
FIG. 2*b* is a section view taken along section A-A (see FIG. 2*a*), of a sprinkler shingle unit 30, according to a preferred embodiment of the present invention.
Figure 2C:
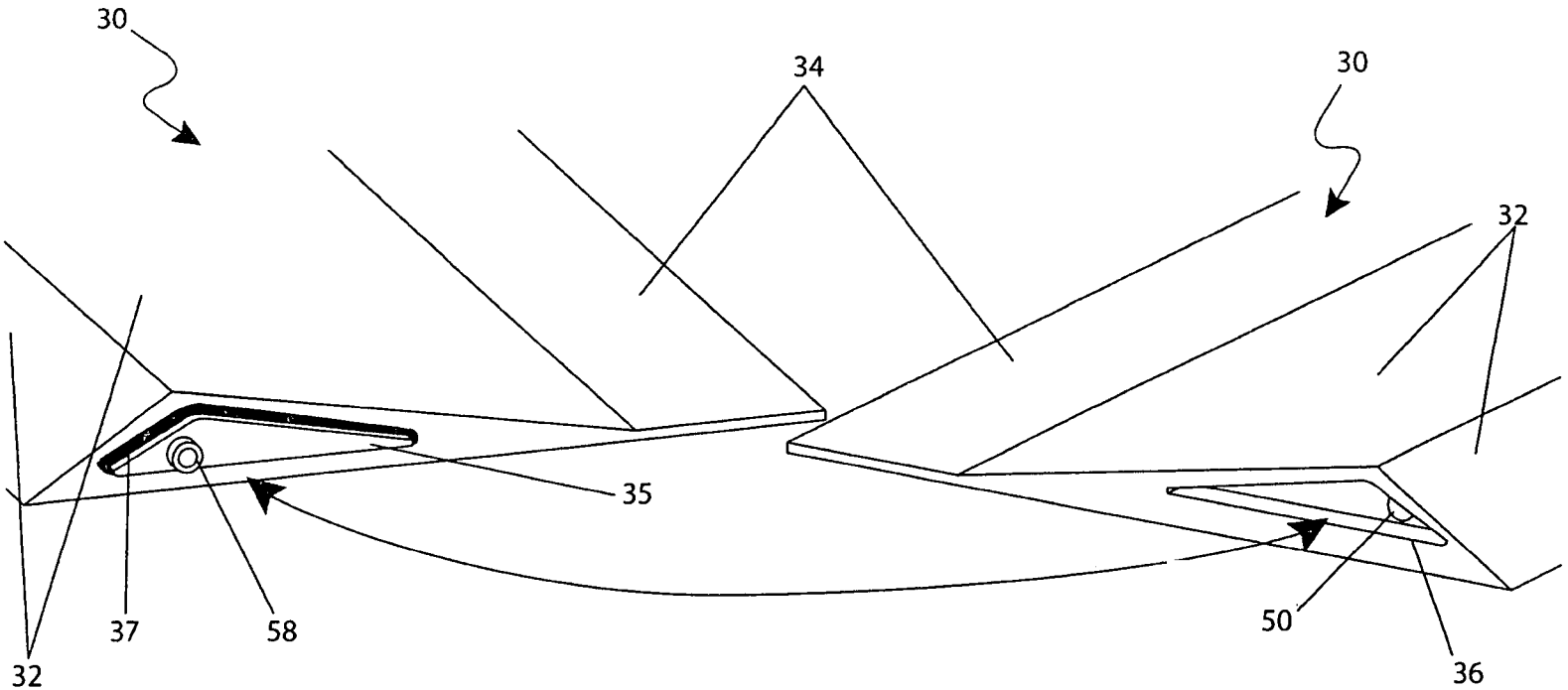
FIG. 2*c* is a perspective view of connecting portions of adjacent sprinkler shingle units 30, according to a preferred embodiment of the present invention.

A plurality of connected sprinkler shingle units 30 form a linear assembly to be discreetly integrated therewithin a conventional roofing system therebetween parallel rows of standard shingles (see FIG. 2*c*). A plurality of interconnected sprinkler shingle units 30, each being approximately 2 feet wide, comprise a continuous lateral row extending therebetween opposing outer edges of a roof area 110 being esthetically integrated therebetween parallel rows of conventional shingles. The sprinkler ridge units 40 are also incorporated discreetly therein a conventional roofing system thereat a roof apex area and are envisioned to be introduced in convenient lengths of approximately six (6) to ten (10) feet in length. Adjacent sprinkler shingle units 30 are in mechanical and fluid communication via interconnecting portions to form a desired overall length (see FIG. 2*c*). The sprinkler ridge units 40 are to be assembled in like manner as the sprinkler shingle unit 30 to form a continuous lateral row of interconnected portions extending between opposing outer edges of a roof area 110.

Figure 3A:
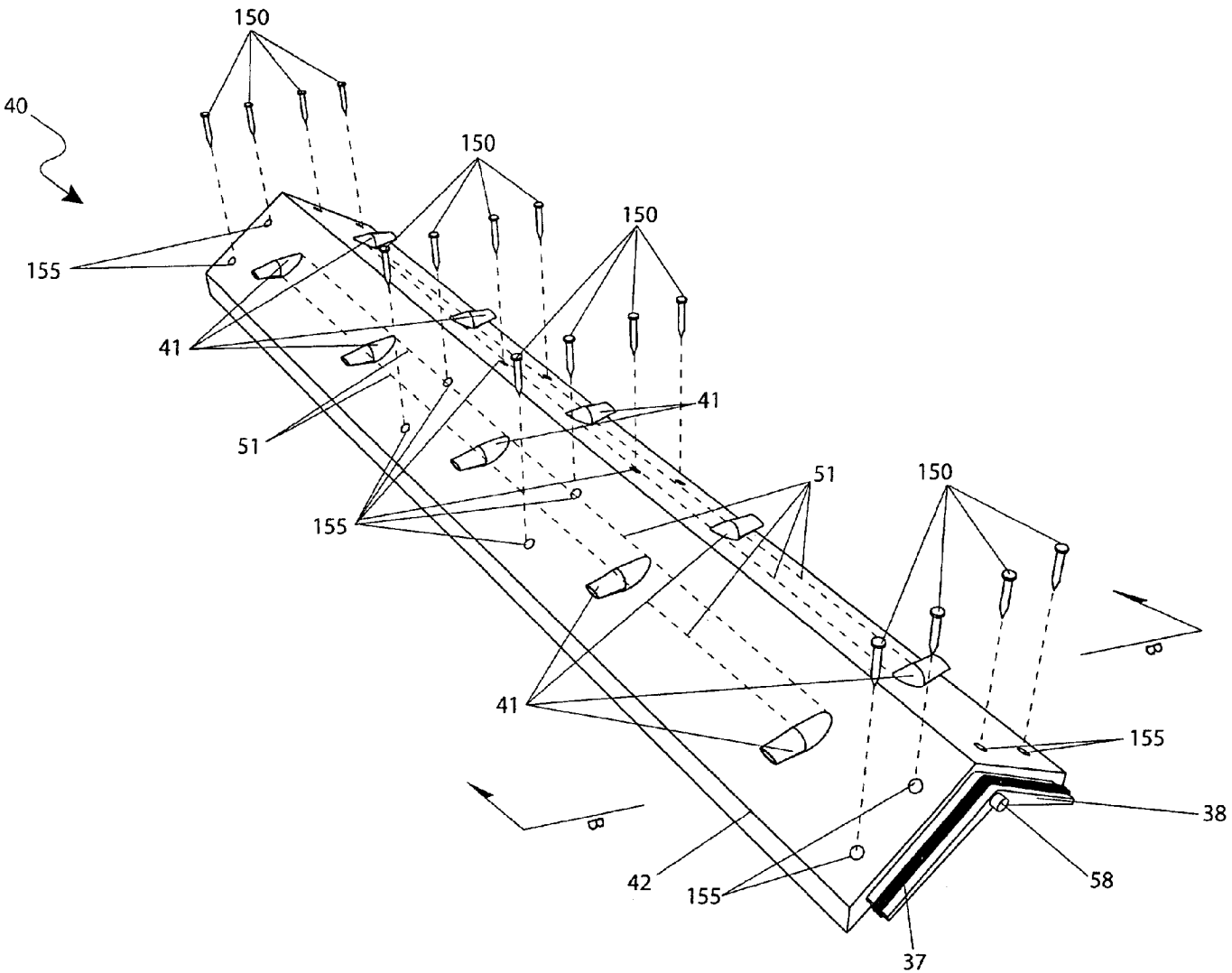
FIG. 3*a* is a front perspective view of a sprinkler ridge unit 40, according to a preferred embodiment of the present invention.
Figure 3B:
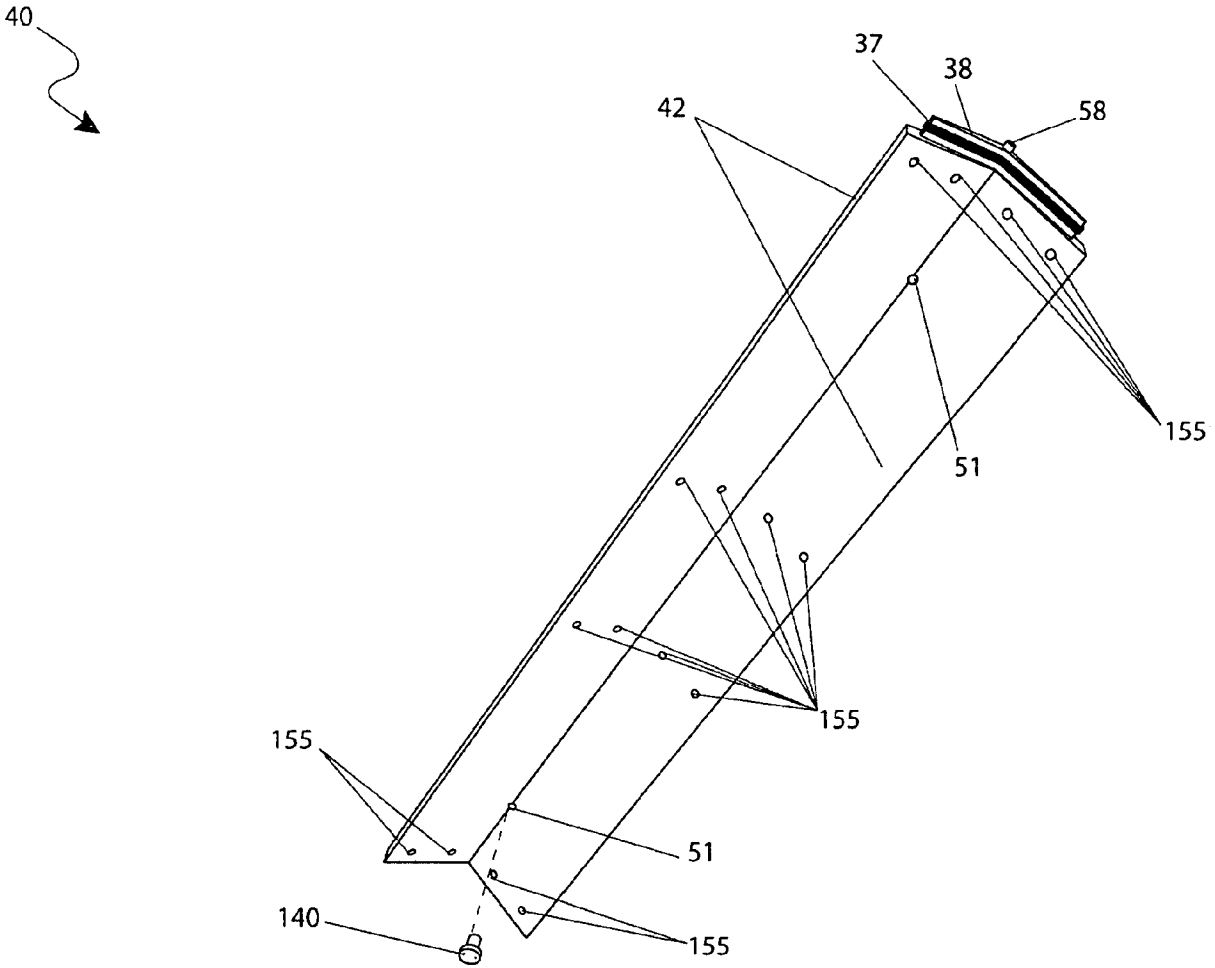
FIG. 3*b* is an upward-looking perspective view of a sprinkler ridge unit 40, according to a preferred embodiment of the present invention.
Figure 3C:
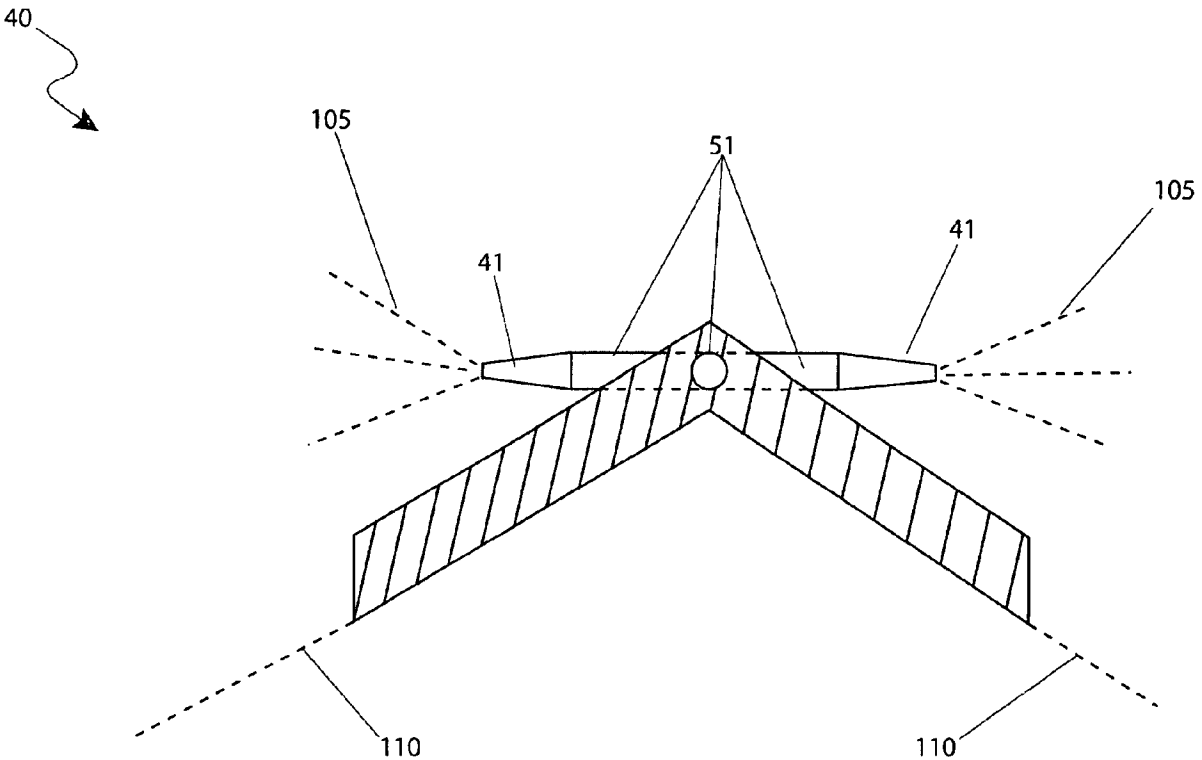
FIG. 3*c* is a section view taken along section B-B (see FIG. 3*a*), of a sprinkler shingle unit 30, according to a preferred embodiment of the present invention.
Figure 3D:
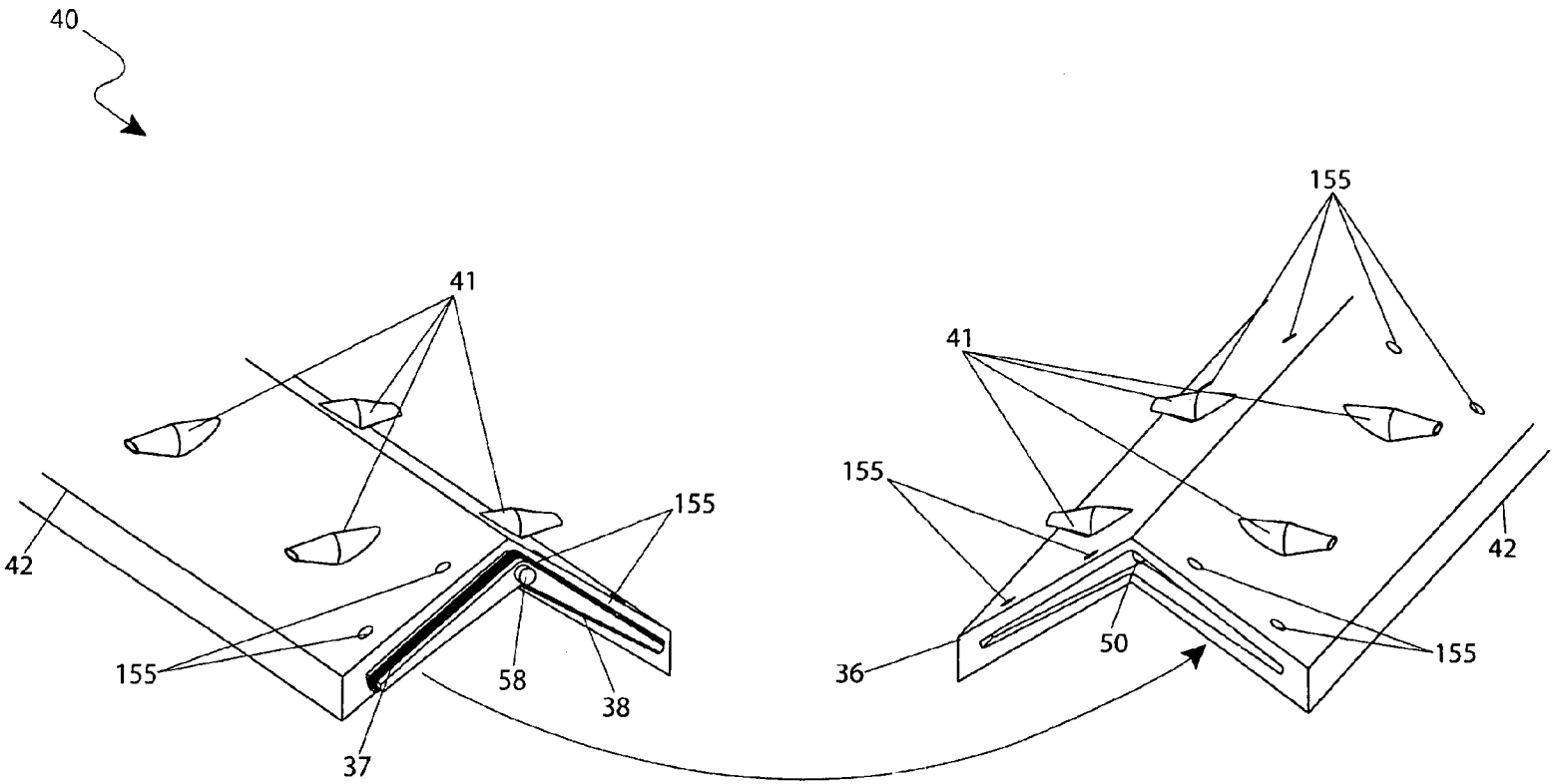
FIG. 3*d* is a perspective view of connecting portions of adjacent sprinkler ridge units 40, according to a preferred embodiment of the present invention.

Said sprinkler units 20, 25, 30, 40 provide a water dispersing means via a plurality of sprinkler nozzles (see FIGS. 2*a*, 3*a*, and 5*a*). Each sprinkler shingle unit 30 is depicted here comprising a single centered sprinkler shingle nozzle 31, whereas each sprinkler ridge unit 40 comprises a plurality of sprinkler ridge nozzles 41 arranged at approximately 2 foot centers, thereby providing complete water coverage of a roof area 110. The right-hand end cap sprinkler units 20 and left-hand end cap sprinkler units 25 comprise generally mirrored versions of each other comprising a single end cap nozzle 21 along a bottom portion thereof being directed theretoward respective end wall areas 112.

A pressurized water flow 100 is supplied thereto the system 10 having originated therefrom an available water source such as a municipal water supply, a reservoir, a well, or the like, and being conveyed therethrough a building structure 120 via a network of system supply plumbing 130. Said system supply plumbing 130 is routed within the building structure 120 having various arrangements based upon specific characteristics of said building structure 120 as well as quantity and location of the sprinkler units 20, 25, 30, 40.

Said system supply plumbing 130 is envisioned to comprise common metal or PVC piping and fittings. Control of said water flow 100 thereto the system 10 is accomplished by a user operated shut-off valve 135 being located at a remote location therefrom the system 10 thereat a ground-floor or basement area. Said water flow 100 is initiated as needed to protect or clean the roof 110 and end wall 112 areas.

The sprinkler shingle units 30 and sprinkler ridge units 40 are to be provided in a variety of lengths to create a desired assembled length of the system 10.

The system 10 is envisioned to be made using rugged corrosion-resistant PVC members being capable of withstanding harsh thermal and environmental conditions associated with a roof area 110. The system 10 would be fabricated preferably using a molding or plastic extrusion process. The system 10 is further envisioned being introduced in a variety of colors and patterns so as to aesthetically match a surrounding shingles being installed in conjunction therewith said system 10. Additionally, the system 10 is envisioned to be sealed using various flexible adhesives, calking compounds, and the like, as needed to prevent damage due to leaking.

In addition to utilization of the system 10 thereto a common residential structure 120, as seen here, said system 10 is envisioned to be adapted for use thereupon various free-standing structures such as, but not limited to, office buildings, apartment complexes, warehouses, garages, and the like.

Referring now to FIGS. 2*a* and 2*b*, a front perspective view and a section view of the sprinkler shingle unit 30, according to the preferred embodiment of the present invention, are disclosed. Each sprinkler shingle unit 30 further comprises a sprinkler shingle nozzle 31, a sprinkler shingle housing 32, a fastening tab 34, and an internal shingle unit conduit 50. The sprinkler shingle housing 32 comprises a solid roofing component having a generally triangular cross-section made using rugged waterproof PVC material. Each sprinkler shingle unit 30 comprises an internal shingle unit conduit 50 formed therein a thick portion thereof along a long axis which provides a fluid communication means thereto a water flow 100. Each shingle unit conduit 50 further provides a threaded attachment means thereto a sprinkler shingle nozzle 31 centered thereupon a front surface of said sprinkler shingle unit 30. The threaded removable attachment of the sprinkler shingle nozzle 31 allows installation of different sprinkler shingle nozzles 31 which provide various spray patterns thereupon the roof area 110. The sprinkler shingle nozzles 31 comprise water dispersing devices providing a conical or fan-shaped water spray pattern 105 along a roof area 110. Said sprinkler shingle nozzles 31 are envisioned to be angled so as to provide maximum surface area coverage of a water spray pattern 105:

The fastening tab 34 comprises an integral flat extension of the sprinkler shingle housing 32 along an entire upper edge facing toward the peek or the roof area 110. The fastening tab 34 takes a form of conventional flashing material, thereby providing an attachment means of the sprinkler shingle unit 30 thereto said roof area 110 using common fasteners 150 such as nails or screws. Said fastening tab 34 allows for attachment of the sprinkler shingle unit 30 thereto the roof surface 100 in a similar manner as a conventional shingle so as to provide a flat and aesthetic appearance when integrated thereinto a roofing shingle installation.

Referring now to FIG. 2*c*, a perspective view of connecting portions of adjacent sprinkler shingle units 30, according to a preferred embodiment of the present invention, is disclosed. A connection therebetween adjacent sprinkler shingle units 30 provides sealing and joining features further comprising a first male connector portion 35, an "O"-ring 37, a male conduit connector 58, and corresponding portions thereat an opposing end position including a first female connector portion 36 and the shingle unit conduit 50. The first male connector portion 35 and the first female connector portion 36 are integrally molded thereinto opposing end portions of each sprinkler shingle unit 30. The first male connector portion 35 comprises an elongated triangular shape extending horizontally therefrom an end portion of the sprinkler shingle unit 30. Said first male connector portion 35 protrudes therefrom said sprinkler shingle unit 30 approximately one (1) inch having an outer surface which is indented therefrom and parallel thereto an end portion of said sprinkler shingle unit 30. Said first male connector portion 35 further comprises an "O"-ring 37 which is affixed therearound an outer surface to provide a continuous sealing means. Correspondingly, the first female connector portion 36 is sized so as to slidingly receive said first male connector portion 35 therein, thereby forming a water-tight seal via contact therewith the "O"-ring 37. The male conduit connector 58 and female shingle unit conduit 50 are integrally molded thereinto the respective first male 35 and first female 36 connector portions and provide a conventional PVC plumbing attachment therebetween adjacent sprinkler shingle units 30 using a standard inserted and cemented joint.

Referring now to FIG. 3*a* through 3*d*, various views of a sprinkler ridge unit 40, according to a preferred embodiment of the present invention, are disclosed. Each sprinkler ridge unit 40 comprises a plurality of sprinkler ridge nozzles 41, a sprinkler ridge housing 42, and an integral ridge unit conduit 51. The sprinkler ridge unit 40 comprises an inverted "V"-shaped form. The sprinkler ridge unit 40 provides mechanical and fluid communication therewith an adjacent sprinkler ridge unit 40 along a horizontal axis via a second male connector portion 38 and a second female connector portion 39 being located along opposing end portions. The second male 38 and second female 39 connector portions utilize an "O"-ring 37 to provide a similar sealing function as the aforementioned first male 35 connector portion while comprising a profile shape similar thereto the sprinkler ridge unit 40. The sprinkler ridge unit 40 comprises similar form and function as a conventional roof ridge member; however, each sprinkler ridge unit 40 provides additional fire-suppression functionality by dispersing a water spray pattern 105 which is emitted therefrom said sprinkler ridge unit 40 therefrom an apex portion of a roof area 110 of a building structure 120. Said sprinkler ridge units 40 are attached thereto the roof area 110 using a plurality of common fasteners 150. The roof area 110 is illustrated here as a typical "A"-frame design; however, the sprinkler ridge units 40 may be introduced having various included angles, thereby matching various roof pitch angles incorporated thereinto different roofs.

Each sprinkler ridge unit 40 comprises a ridge unit conduit 51 providing an internal network of ports along a length of said sprinkler ridge unit 40. The ridge unit conduit 51 provides a plumbing connection means thereto water supply plumbing 115 via a conventional PVC inserted plumbing connections therealong a lower surface adjacent thereto each end portion. Said water supply plumbing 115 is envisioned to extend therefrom the sprinkler ridge unit 40 and penetrate the roof area 110 and make subsequent connection therewith a network of water supply plumbing system 115 located therewithin an internal space of the building structure 120, thereby utilizing an available pressurized water flow 100. During installation, one (1) of the two (2) openings of the ridge unit conduit 51 may be plugged using a standard PVC pipe cap 140, if not needed. Said ridge unit conduit 51 further provides a fluid communication port therealong side surfaces thereto a plurality of sprinkler ridge nozzles 41 via standard threaded connections. Each sprinkler ridge unit 40 is positioned along the roof apex area 100, thereby providing an even distribution of said pressurized water flow 100 thereto both sides of the roof area 110 for optimum moisture propagation. It is envisioned that the sprinkler ridge unit 40 may also be introduced having integral ventilation features similar thereto conventional ridge vent units common in the roofing industry.

The sprinkler ridge nozzles 41 are arranged along opposing upper surfaces of said sprinkler ridge units 40 extending therefrom in a generally horizontal plane. The sprinkler ridge nozzles 41 are arranged in an equally-spaced pattern being similar in construction, materials, and interchangeable functionality as the aforementioned sprinkler shingle nozzles 31 (see FIG. 2*a*), thereby providing maximum surface area coverage therefrom a water spray pattern 105 thereupon a roof area 110.

Referring now to FIG. 4*a* through 4*d*, various views of the end cap unit portions 20, 25 of the system 10, according to the preferred embodiment of the present invention, are disclosed. The end cap units 20, 25 further comprises an end cap nozzle 21 and an internal end cap conduit 52. The end cap units 20, 25 provide left-hand 20 and right-hand 25 configurations, thereby facilitating an installation means thereto an assembly of sprinkler shingle units 30 along opposing end portions thereof along a roof area 110 (see FIG. 1). The internal end cap conduit portion 52 of the end cap units 20, 25 provide a plumbing connection therewith water supply plumbing 115 in a similar manner as the aforementioned sprinkler ridge units 40. Said end cap conduit 52 provides a PVC plumbing connection therewith said water supply plumbing 115 within the building structure 120, thereby providing a water flow 100 thereto said end cap units 20, 25 and affixed sprinkler shingle units 30 (see FIG. 3*b*). During installation, any openings of the ridge unit conduit 52 not used for fluid connection thereto the water supply plumbing 115 may be plugged using a standard adhesive-type PVC pipe cap 140. The water supply plumbing 115 is envisioned to be an extension thereof an existing water system within the building structure 120. Said plumbing connection therebetween the end cap conduit 52 and the water supply plumbing 115 is envisioned to occur via a penetration therethrough the roof area 110. The end cap units 20, 25 further comprise an end cap nozzle 21 being mounted and directed theretoward a respective end wall area 112 of the building structure 120. The end cap nozzle 21 provides similar construction, materials, and interchangeable function as the aforementioned sprinkler shingle nozzles 31 (see FIG. 2*a*). The right-hand end cap unit 20 illustrated in FIG. 4*a* depicts a single end cap nozzle 21; however, it is understood that any number of end cap nozzles 21 and corresponding end cap conduit 52 arrangements may be provided based upon specific applications of the system 10 and a desired water spray pattern 105.

The end cap units 20, 25 comprise an "L"-shaped form being in mechanical and fluid communication therewith an affixed sprinkler shingle unit 30 by utilizing an integral first female connector portion 36 for the right-hand end cap unit 20 and a first male connector portion 35 for the left-hand end cap unit 25 (see FIGS. 4*c* and 4*d*). A proximal end portion of the right-hand end cap unit 20 as illustrated in FIG. 4*a*, extends in a downward direction at a right angle to conform thereto an edge or fascia portion of a roof area 110, thereby providing a water spray pattern 105 thereupon the end wall area 112 therefrom the end cap nozzle 21. The end cap unit 20 comprises an internal end cap conduit 52, thereby providing a threaded plumbing attachment means thereto the end cap nozzle 21 along a lower surface in a similar manner as the aforementioned shingle unit conduit portion 50 of the sprinkler shingle unit 30. Said end cap nozzle 21 provides a dispersing orifice envisioned to provide a fan or conical-shaped water spray pattern 105 thereto said end wall area 112, thereby providing maximum water coverage and protection thereto the structure 120. Both end cap units 20 provide a secure attachment means thereto the roof area 110 via insertion of common fasteners 150 such as nails, screws, or the like, therethrough integrally-molded fastener apertures 155. The end cap units 20, 25 are envisioned to comprise an identically-contoured upper surface as the adjacent adjoining sprinkler shingle units 30, thereby providing a smooth and aesthetic transition therebetween (see FIG. 1).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. Installation of the system 10 is envisioned to be accomplished by trained professional craftsmen. After initial purchase or acquisition of the system 10, it would be installed as indicated in FIG. 1.

The method of installing and utilizing the preferred embodiment of the system 10 may be achieved by performing the following steps: beginning a roofing project in a normal manner by fastening rows of conventional shingles starting therefrom a lower edge region; integrating and mounting a desired number of sprinkler shingle units 30 in a linear fashion across a roof area 110 by connecting the first male 35 and first female 36 connector portions; inserting and cementing the male conduit connectors 58 thereto corresponding shingle unit conduits 50; fastening the fastening tabs 34 using common fasteners 150; connecting a right-hand end cap sprinkler unit 20 and left-handed end cap sprinkler unit 25 thereto end portions of the previously fastened sprinkler shingle units 30 in like manner; securing said right-hand 20 and left-hand 25 end cap sprinkler units thereto the roof area 110 using the fastener apertures 155 and common fasteners 150; preparing a roof area 110 therewith properly positioned plumbing penetration holes in anticipation therewith connection thereto water supply plumbing 115 within the building structure 120; repeating the previous steps to install additional rows of sprinkler shingle units 30 and corresponding end caps 20, 25 as desired therebetween a lower edge and apex portion of a roof area 110 while alternately installing rows of normal roofing shingles; connecting and fastening a plurality of sprinkler ridge units 40 therealong an apex portion of the roof area 110 in a linear fashion by cementing and inserting the ridge conduit portions 51 and male conduit connectors 58 while inserting respective second male 38 and female 39 connector portions; preparing a roof area 110 therewith properly positioned plumbing penetration holes in anticipation therewith connection of the sprinkler ridge units 40 thereto water supply plumbing 115 within the building structure 120; fastening said sprinkler ridge units 40 thereto the roof area 110 using the integral fastener apertures 155 and common fasteners 150; continuing to install sprinkler ridge units 40 until an entire apex portion of the roof area 110 is covered; installing water supply plumbing 115 and water valve 135 by expanding an existing water supply plumbing system 115 therewithin the building structure 120 thereto a location therewithin the building structure 120 thereto a corresponding portions of the system 10 to be connected; connecting the water supply plumbing 115 thereto the ridge unit conduits 51 and end cap conduits 52 by utilizing standard PVC plumbing joining techniques while accessing said connection therefrom an inside space of said building structure 120; initiating a water flow 100 therethrough the system 10 using a remotely located water valve 135; dispersing the resultant water spray pattern 105 therefrom the sprinkler units 20, 25, 30, 40 thereonto the roof area 110 to suppress possible air-borne ignition sources such as glowing ashes or embers therefrom a nearby wild fire or structure fire; deactivating the system 10 after a threat of fire thereto the building structure 120 passes by turning off the valve 135; initiating said water spray pattern 105 thereonto the roof area 110 to protect said building structure 120 therefrom chemical, biological, and/or radiological (CBR) attacks by rinsing contaminates off said roof 110 and wall 112 areas; utilizing the system 10 and said water spray patterns 105 thereupon the roof area 110 and end wall areas 112 to clean and remove accumulated dirt and debris, as desired; and, benefiting from increased protection of the building structure 120 using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An integral fire suppression system attachable thereto a roof of a building structure, comprising:

a plurality of shingle units, each comprising integral shingle water plumbing in fluid communication therewith a shingle water distribution means, each further comprising:

a shingle housing, comprising a low profile with tapered upper and lower peripheral edges;

a fastening tab, comprising an integral flat extension of said upper peripheral edge thereof said shingle housing and fastenable to said roof;

a first male connector portion comprising an elongated triangular shape outwardly extending from a first side of said shingle housing and comprising a sealing means on an outer periphery thereof; and, a first female connector portion comprising an elongated triangular shape inwardly extending in a second side of said shingle housing;

at least one (1) end cap unit attached thereto a terminal shingle unit thereof said plurality of shingle units, said at least one (1) end cap unit comprising integral end cap water plumbing in fluid communication therewith an end cap water distribution means; and, water supply plumbing in fluid communication therewith a water supply and said at least one (1) end cap unit, comprising a shut-off valve;

wherein said shingle housing comprises an aerodynamic shape;

wherein said first female connector portion comprises a corresponding size and geometry to receive said first male connector portion, thereby interconnecting adjacent shingle units;

wherein said sealing means provides a water-tight seal between adjacent interconnected shingle units;

wherein said plurality of shingle units comprise an interconnecting means to provide a linear assembly of a desired length;

wherein said system distributes water therefrom said water supply thereto said roof;

wherein said system provides a fire protection means thereto said building structure;

wherein said system provides a periodic cleaning means thereto said roof thereof said building structure;

wherein said system provides fire protection thereto said building structure;

wherein said shingle water plumbing further comprises:

a linear cylindrical conduit, comprising a first end located thereat said first side thereof said shingle housing and a second end located thereat said second side thereof said shingle housing;

at least one (1) port in fluid communication therewith said end cap distribution means;

a male conduit connector located thereat said first end thereof said conduit; and, a female conduit connector located thereat said second end thereof said conduit;

wherein said female conduit connector comprises a corresponding size and geometry to receive said male conduit connector;

wherein said shingle water distribution means further comprises a nozzle oriented thereat a front location thereof said shingle housing, further comprising a fan-shaped water spray;

wherein said fastening tab is integrally connected with said upper peripheral edge of said shingle housing, said fastening tab being coplanar with a bottom surface of said shingle housing;

wherein said male conduit connector is connected to said first male connector portion and extends outwardly therefrom such that said conduit connector is spaced from said shingle housing; and, wherein said nozzle is removably attached to said conduit and extends outwardly from said shingle housing along a path registered parallel to said fastening tab, wherein said nozzle is oppositely faced away from said fastening tab.

2. The system of claim 1, wherein said linear assembly is integrated within a roofing system having shingles between parallel rows of said shingles.

3. The system of claim 1, wherein said at least one (1) end cap each further comprise:

an end cap housing, further comprising an "L"-shaped form comprising a fastening means thereto said roof and a shingle connector portion with a sealing means;

wherein a proximal end thereof said end cap housing extends downward at a right angle therefrom a distal end thereof said end cap housing;

wherein said proximal end provides a conforming means thereto an end wall area thereof said building structure;

wherein said shingle connector portion interconnects said end cap housing thereto said shingle housing thereof said terminal shingle unit; and, wherein said sealing means provides a water-tight seal therebetween said end cap housing and said terminal shingle unit.

4. The system of claim 3, wherein said end cap water plumbing further comprises:

a "T"-shaped cylindrical conduit, comprising a first end located thereat said proximal side thereof said end cap housing, a second end located thereat said distal side thereof said end cap housing, and a central end attachable thereto said water supply plumbing;

wherein said female conduit connector comprises a corresponding size and geometry to receive a male conduit connector thereof said terminal shingle unit; and, wherein said end cap plumbing provides a water distribution means therefrom said water supply thereto said terminal shingle unit.

5. The system of claim 4, wherein said end cap water distribution means further comprises a nozzle oriented thereat said first end thereof said end cap housing, further comprising a fan-shaped water spray thereupon an end wall area.

6. The system of claim 5, wherein said end cap housing further comprises a right-hand configuration, wherein said shingle connector portion comprises an elongated triangular shape inwardly extending therein said distal end thereof said end cap housing and said first end comprises a female conduit connector;

wherein said shingle connector portion comprises a corresponding size and geometry to receive a first male connector portion thereof said terminal shingle unit; and, wherein said female conduit connector comprises a corresponding size and geometry to receive a male conduit connector thereof said terminal shingle unit.

7. The system of claim 6, wherein said end cap housing comprises a left-hand configuration, wherein said shingle connector portion comprises an elongated triangular shape outwardly extending therefrom said distal end thereof said end cap housing and said first end comprises a male conduit connector;

wherein said shingle connector portion comprises a corresponding size and geometry to insert within a first female connector portion thereof said terminal shingle unit; and, wherein said male conduit connector comprises a corresponding size and geometry to insert within a female conduit connector thereof said terminal shingle unit.

8. An integral fire suppression system attachable thereto a roof of a building structure, comprising:

a plurality of shingle units, each comprising integral shingle water plumbing in fluid communication therewith a shingle water distribution means, each further comprising:

a shingle housing, comprising a low profile with tapered upper and lower peripheral edges;

a fastening tab, comprising an integral flat extension of said upper peripheral edge of said shingle housing and fastenable to said roof;

a first male connector portion comprising an elongated triangular shape outwardly extending from a first side of said shingle housing and comprising a sealing means on an outer periphery thereof;

a first female connector portion comprising an elongated triangular shape inwardly extending in a second side of said shingle housing;

at least one (1) end cap unit attached thereto a terminal shingle unit thereof said plurality of shingle units, said at least one (1) end cap unit comprising integral end cap water plumbing in fluid communication therewith an end cap water distribution means;

at least one (1) ridge unit, each comprising integral ridge unit water plumbing in fluid communication therewith a ridge unit water distribution means; and, water supply plumbing in fluid communication therewith a water supply, said at least one (1) end cap unit, and said at least one (1) ridge unit, comprising a shut-off valve;

wherein said shingle water plumbing further comprises:

a linear cylindrical conduit, comprising a first end located at said first side of said shingle housing and a second end located at said second side of said shingle housing;

at least one (1) port in fluid communication with said end cap distribution means;

a male conduit connector located at said first end of said conduit; and, a female conduit connector located at said second end of said conduit;

wherein said female conduit connector comprises a corresponding size and geometry to receive said male conduit connector;

wherein said shingle housing comprises an aerodynamic shape;

wherein said first female connector portion comprises a corresponding size and geometry to receive said first male connector portion, thereby interconnecting adjacent shingle units; and, wherein said sealing means provides a water-tight seal between adjacent interconnected shingle units;

wherein said plurality of shingle units comprise an interconnecting means to provide a linear assembly of a desired length;

wherein said at least one (1) ridge unit comprises an interconnecting means to provide a linear assembly of a desired length;

wherein said system distributes water therefrom a water supply thereto said roof;

wherein said system provides a fire protection means thereto said building structure;

wherein said system provides a periodic cleaning means thereto said roof thereof said building structure;

wherein said system provides fire protection thereto said building structure;

wherein said shingle water distribution means further comprises a nozzle oriented thereat a front location thereof said shingle housing, further comprising a fan-shaped water spray;

wherein said fastening tab is integrally connected with said upper peripheral edge of said shingle housing, said fastening tab being coplanar with a bottom surface of said shingle housing;

wherein said male conduit connector is connected to said first male connector portion and extends outwardly therefrom such that said conduit connector is spaced from said shingle housing; and, wherein said nozzle is removably attached to said conduit and extends outwardly from said shingle housing along a path registered parallel to said fastening tab, wherein said nozzle is oppositely faced away from said fastening tab.

9. The system of claim 8, wherein said at least one (1) end cap each further comprise:

an end cap housing, further comprising an "L"-shaped form comprising a fastening means thereto said roof and a shingle connector portion with a sealing means;

wherein a proximal end thereof said end cap housing extends downward at a right angle therefrom a distal end thereof said end cap housing; and, said end cap water plumbing, further comprising a "T"-shaped cylindrical conduit, comprising a first end located thereat said proximal side thereof said end cap housing, a second end located thereat said distal side thereof said end cap housing, and a central end attachable thereto said water supply plumbing;

wherein said proximal end provides a conforming means thereto an end wall area thereof said building structure;

wherein said shingle connector portion interconnects said end cap housing thereto said shingle housing thereof said terminal shingle unit;

wherein said sealing means provides a water-tight seal therebetween said end cap housing and said terminal shingle unit;

wherein said female conduit connector comprises a corresponding size and geometry to receive a male conduit connector thereof said terminal shingle unit; and, wherein said end cap plumbing provides a water distribution means therefrom said water supply thereto said terminal shingle unit.

10. The system of claim 9, wherein said end cap water distribution means further comprises a nozzle oriented thereat said first end thereof said end cap housing, further comprising a fan-shaped water spray thereupon an end wall area.

11. The system of claim 10, wherein said end cap housing further comprises a right-hand configuration, wherein said shingle connector portion comprises an elongated triangular shape inwardly extending therein said distal end thereof said end cap housing and said first end comprises a female conduit connector;

wherein said shingle connector portion comprises a corresponding size and geometry to receive a first male connector portion thereof said terminal shingle unit; and, wherein said female conduit connector comprises a corresponding size and geometry to receive a male conduit connector thereof said terminal shingle unit.

12. The system of claim 10, wherein said end cap housing comprises a left-hand configuration, wherein said shingle connector portion comprises an elongated triangular shape outwardly extending therefrom said distal end thereof said end cap housing and said first end comprises a male conduit connector;

wherein said shingle connector portion comprises a corresponding size and geometry to insert within a first female connector portion thereof said terminal shingle unit; and, wherein said male conduit connector comprises a corresponding size and geometry to insert within a female conduit connector thereof said terminal shingle unit.

13. The system of claim 8, wherein said at least one (1) ridge unit each further comprises:

a ridge unit housing, comprising an inverted "V"-shape with a fastening means thereto a ridge area thereof said roof;

a second male connector portion comprising an elongated triangular shape outwardly extending therefrom a first ridge unit side thereof said ridge unit housing and comprising a sealing means thereon an outer periphery thereof;

a second female connector portion comprising an elongated triangular inwardly extending therein a second ridge unit side thereof said ridge unit housing; and, said ridge unit water plumbing, further comprising:

a pair of linear cylindrical conduits, each comprising a first ridge plumbing end located thereat said first ridge unit side thereof said shingle housing, a second ridge plumbing end located thereat said second ridge unit side thereof said shingle housing, and an attachment thereto said water supply plumbing;

at least one (1) port in fluid communication therewith said ridge unit water distribution means;

a male conduit connector located thereat said first ridge unit end thereof each of said pair of conduits; and, a female conduit connector located thereat said second ridge unit end thereof each of said pair of conduits;

wherein said female conduit connector comprises a corresponding size and geometry to receive said male conduit connector;

wherein said second female connector portion comprises a corresponding size and geometry to receive said second male connector portion, thereby interconnecting adjacent ridge units; and, wherein said sealing means provides a water-tight seal therebetween adjacent interconnected ridge units.

14. The system of claim 13, wherein said ridge unit water distribution means further comprises a nozzle thereat opposing front locations thereof said ridge unit housing, further comprising a fan-shaped water spray.

15. The system of claim 8, wherein said linear assembly thereof said plurality of shingle units are integrated within a roofing system having shingles between parallel rows of said shingles.

* * * * *